United States Patent [19]

Lehmann et al.

[11] 4,230,438

[45] Oct. 28, 1980

[54] ROTARY PUMP ASSEMBLY

[75] Inventors: Wilfried Lehmann, Heiligenstedten; Hermann Muller, Oldendorf; Bodo Baranek, Wilster, all of Fed. Rep. of Germany

[73] Assignee: Sihi GmbH & Co. KG, Itzehoe, Fed. Rep. of Germany

[21] Appl. No.: 35,224

[22] Filed: May 2, 1979

Related U.S. Application Data

[63] Continuation of Ser. No. 901,842, May 1, 1978, abandoned, which is a continuation of Ser. No. 701,754, Jun. 30, 1976, abandoned.

[30] Foreign Application Priority Data

Jul. 2, 1975 [DE] Fed. Rep. of Germany ..... 2529458

[51] Int. Cl.[3] ..... F04D 29/04

[52] U.S. Cl. ..... 415/122 R; 415/170 R; 417/359

[58] Field of Search ..... 415/122 R, 170 R, 170 A, 415/172 R, 205; 417/423 R, 424, 359, 360, 361; 308/26, 175, 184 R

[56] References Cited

U.S. PATENT DOCUMENTS

| | | | |
|---|---|---|---|
| 1,700,678 | 1/1929 | Jennings | 417/359 |
| 2,155,919 | 4/1939 | Wooler et al. | 308/184 R |
| 2,364,168 | 12/1944 | Shallenberg | 417/423 R |
| 2,926,051 | 2/1960 | Cazier et al. | 308/184 R |
| 3,249,057 | 5/1966 | Callahan | 417/424 |
| 3,324,798 | 6/1967 | Freed et al. | 417/360 |

*Primary Examiner*—Louis J. Casaregola
*Attorney, Agent, or Firm*—Haseltine, Lake & Waters

[57] ABSTRACT

A rotary pump assembly including a pump having a pump housing, a pump shaft disposed within the pump housing, a runner mounted concentrically on the pump shaft, a motor having a motor housing, and an intermediate housing interconnected between the pump- and motor-housings. The pump shaft has an end facing the motor, and the pump shaft end is formed as a hollow shaft fittingly mounted on the motor shaft. A bearing support is disposed in the intermediate housing for supporting the hollow pump shaft end, and is formed as an axial bearing with substantially no radial bearing capacity.

4 Claims, 1 Drawing Figure

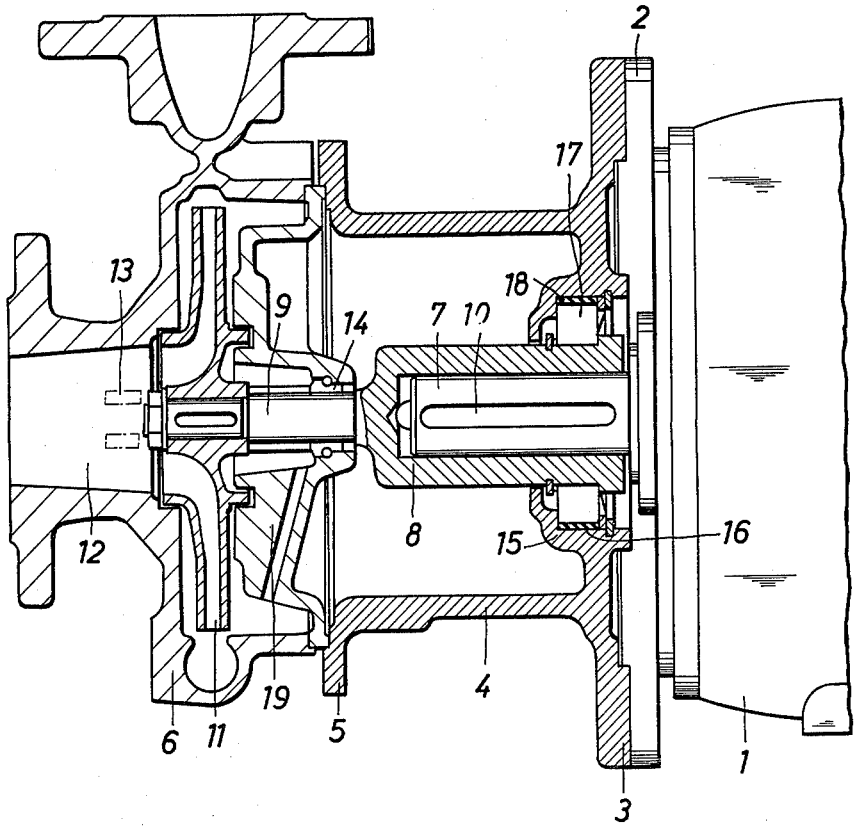
2
17
18
13
9
14
7
10
12
8
15
16
19
4
6
11
5
1
3

ROTARY PUMP ASSEMBLY

CROSS RELATED APPLICATION

This Application is a continuation of Ser. No. 901,842 filed May 1, 1978 and now abandoned, which in turn is a continuation of Ser. No. 701,754 filed June 30, 1976 and now abandoned.

FIELD OF THE INVENTION

The invention relates to a rotary pump assembly consisting of a pump with a pump housing, a pump shaft and at least one runner, of a motor with a motor housing, and of a motor shaft coaxial to the pump shaft, and of an intermediate housing, rigidly connected with the pump housing and the motor housing, whereby the end of the pump shaft on the side of the motor formed as a hollow shaft is fittingly mounted on the motor shaft and abutted by the support arrangements provided in the intermediate housing. The expression "rotary pump" is applied in the present connection for all pumps, in which a liquid or gaseous medium is conveyed by a rotary action of a runner in a housing, preferably, however, for those pumps whose pump shaft has to receive certain axial forces, which is particularly the case in centrifugal pumps and in some side channel- or water-ring pumps.

BACKGROUND

Rotary pump assemblies are known, wherein the runner of the pump is mounted on the end of the motor shaft. These pump assemblies have the disadvantage, that motors with a special shaft must be used, and that the motor bearings must be implemented in a strengthened manner for receiving the pump forces.

There are also known rotary pump assemblies, where the pump shaft implemented as a hollow shaft is mounted on the normally short stub shaft of the motor and is supported by the same, without requiring any additional bearing (U.S. Pat. No. 2,291,346). This implementation has also the disadvantage, however, that the bearings of the motor must be implemented in a strengthened manner for receiving the pump forces. Such special implementations of drive motors are expensive and make procurement of spare parts more difficult.

In the new development it has therefore been decided to free the motor shaft from the forces of the pump completely, by the pump shaft being completely supported, which always is the case in pumps of the type which are not coupled to a motor to form an assembly. It is known, for example (German printed application No. 1,653,721) to completely support the motor-facing end of the pump shaft, which is formed as a hollow shaft and mounted on the motor shaft in the intermediate housing, by means of two grooved ball bearings. This has the disadvantage, however, that a high manufacturing precision is necessary, so that the bearings in the intermediate housing and in the motor are precisely aligned. In lieu thereof, it is also possible to select a yieldable coupling, equalizing alignment errors between the pump shaft and the motor shaft, which, however, results in additional expense. In order to equalize alignment errors and to nevertheless obtain an essentially rigid connection between the pump shaft and the motor shaft it is also known (French Patent 1,391,431) to implement the intermediate housing without any devices for centering with respect to the motor housing, the intermediate housing containing the complete bearing support of the pump shaft, and to only then connect these parts rigidly to one another, if the bearing supports have taken on an aligned position during assembly. It has been shown, however, that the required precision of assembly or mounting is not obtainable under practical circumstances and also would be too costly.

SUMMARY OF THE INVENTION

It is therefore an object of the invention to provide a pump assembly of the initially cited type, which is less costly and which in particular requires a lower manufacturing and assembly precision than known pump assemblies, and nevertheless maintains the advantage of their smaller construction length.

While the latter development is characterized by the motor being completely freed from the pump forces, the invention is based on the recognition that it is definitely permissible to load the motor with part of the pump forces, although only with the radially acting forces, while the axial forces must be maintained remote from the motor shaft. The inventive solution consists of the bearing support arrangements provided in the intermediate housing being exclusively formed by an axial bearing.

In other words, the pump shaft is carried in a radial direction entirely or substantially by the motor shaft, while the axial forces are received by the axial support bearing disposed in the intermediate housing.

It is not required that the axial support bearing be completely free and floatingly disposed in an intermediate housing. A construction is rather preferred in which the axial support bearing is abutted in a radial direction by a yieldable member, i.e., a certain damping of radial vibrations for the protection of the radial support bearing and the parts connected therewith results therefrom. The yieldable member is, for example, a soft elastic ring between the axial support bearing and the bore of the intermediate housing receiving the same. Also permanently plastic material can be used for formation of the yieldable member.

If the pump shaft is very long, for example in pumps with several runners, then it may be advantageous to dispose an additional radial support bearing on the side of the motor facing away from the runner or runners. Contrary to a support bearing close to the motor, these support bearings do not require any costly provisions with respect to a device precisely aligned with the motor support bearings, since this additional support bearing is spaced at a considerable distance from the motor shaft, so that any radial imprecisions may be equalized.

BRIEF DESCRIPTION OF THE DRAWINGS

The sole FIGURE shows a longitudinal section of an embodiment according to the invention.

DETAILED DESCRIPTION

An electric motor disposed in a housing 1 has an assembly flange 2, on which the appropriate flange 3 of an intermediate housing 4 is attached by screws (not shown). A pump housing 6 is attached to a flange 5 of the intermediate housing by means of screws (not shown). The motor and the pump housing are substantially aligned.

The normally short-formed stub shaft 7 of the motor shaft projects from the motor 1 into the intermediate housing 4. The end of the pump shaft 9 formed as a hollow shaft 8 is mounted on stub shaft 7 with a tight fit (play-fit) and secured therewith in a rotationally secured manner by means of groove or slot 10. On the end of the pump shaft remote from the pump there is mounted a rotor or runner 11. A radially acting auxiliary support bearing 13 for the pump shaft, shown in dot-dashed outline, may also be provided on a side remote from the motor in the suction opening 12 of the pump. The pump housing 6 does not contain any other support for the pump shaft except for bearing 13. The pump housing 6 contains suction-and pressure supports and is closed off on the pressure side by a housing portion 19. Numeral 14 indicates a sealing which has no bearing-support function.

A seat in an form of a bore 16 for the axial support bearing 17 is formed in an inwardly projecting portion 15 of the intermediate housing 4, which is axially fixed both with respect to the intermediate housing, as well as with respect to the hollow shaft 8. Between the outer periphery of the axial support bearing 17 and the bore 16 there is disposed an elastic and soft ring-shaped intermediate layer 18, which, for example, may consist of soft rubber. It permits radial movement of the axial support bearing 17 for equalization of any alignment errors with respect to the motor, and damps any possible vibrations. Alternatively, the intermediate layer 18 may be omitted. The axial support bearing is then movable freely in a radial direction.

What is claimed is:

1. A rotary pump assembly comprising:

a pump having a pump housing;

a pump shaft disposed within said pump housing;

a runner mounted concentrically on said pump shaft;

a motor having a motor housing a shaft coaxially aligned with said pump shaft;

an intermediate housing interconnected between said pump and motor housings, said pump shaft having an end facing said motor, the pump shaft end being formed as a hollow shaft fittingly mounted coaxially on said motor shaft and secured for rotation therewith to form a cantilever arrangement thereon; and bearing support means disposed in said intermediate housing and engaging said hollow shaft for supporting said pump shaft end for resisting only axial forces applied to said pump shaft, said bearing support means consisting solely of an axial bearing engaging and securing said pump shaft end axially in said intermediate housing, radial forces applied to said pump shaft being resisted by the motor shaft, said intermediate housing having a bore, said axial bearing being axially secured to said intermediate housing in said bore and axially fixed with respect to said hollow shaft at locations where said hollow shaft receives said motor shaft.

2. A rotary pump assembly according to claim 1 further comprising a yieldable member supporting said axial bearing in said intermediate housing for movement in a radial direction.

3. A rotary pump assembly according to claim 1 wherein said runner has a side facing away from said motor and further comprising a radial bearing disposed on the side of said runner facing away from said motor.

4. A rotary pump assembly as claimed in claim 1 wherein said hollow shaft is fitted on substantially the entire length of the motor shaft projecting into said intermediate housing.

* * * * *